US007351069B2

(12) United States Patent
Matsuo et al.

(10) Patent No.: US 7,351,069 B2
(45) Date of Patent: Apr. 1, 2008

(54) DOUBLE-SIDED CONNECTOR CAPABLE OF EASILY AND ACCURATELY POSITIONING A CONNECTION MEMBER

(75) Inventors: Seiya Matsuo, Tokyo (JP); Akane Yoneta, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/729,713

(22) Filed: Mar. 29, 2007

(65) Prior Publication Data

US 2007/0232103 A1 Oct. 4, 2007

(30) Foreign Application Priority Data

Mar. 31, 2006 (JP) ..... 2006-098561

(51) Int. Cl.
*H01R 12/00* (2006.01)

(52) U.S. Cl. ..... 439/66

(58) Field of Classification Search ..... 439/67, 439/66, 91, 86, 81, 71, 591, 592, 72
See application file for complete search history.

(56) References Cited

U.S. PATENT DOCUMENTS 3,924,915 A * 12/1975 Conrad ..... 439/66
3,998,512 A * 12/1976 Anhalt et al. ..... 439/66
6,241,533 B1 * 6/2001 Matsumoto ..... 439/67

FOREIGN PATENT DOCUMENTS

JP 2005228504 8/2005

* cited by examiner

*Primary Examiner*—Edwin A. Leon
(74) *Attorney, Agent, or Firm*—Collard & Roe, P.C.

(57) ABSTRACT

In a connector including a frame having an engaged portion and a connection member adapted to be inserted into the frame either in a first direction or in a second direction reverse to the first direction, the connection member includes an elastic member coupled to the frame. A conductor is coupled to the elastic member and protrudes from the frame in the first and the second directions to be electrically connected to the connection objects. First and second engaging portions protrude from the elastic member in a third direction perpendicular to the first direction to be engaged with the engaged portion in the first abs the second directions, respectively. Each of the first and the second engaging portions has a slant surface formed on a side opposite to the engaged portion.

8 Claims, 11 Drawing Sheets

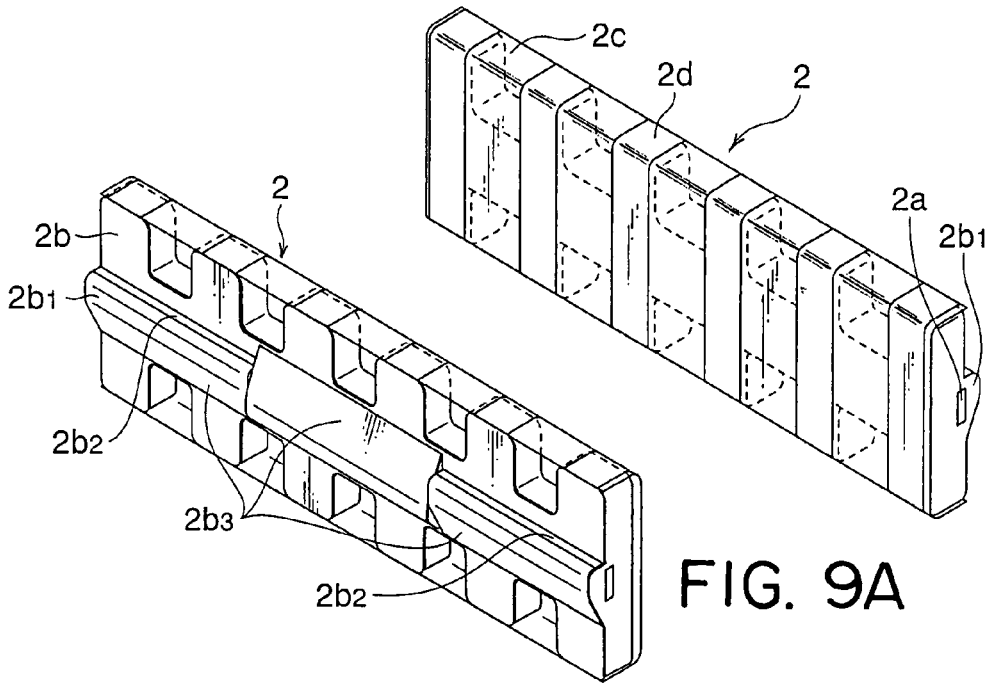
FIG. 9A
FIG. 9B
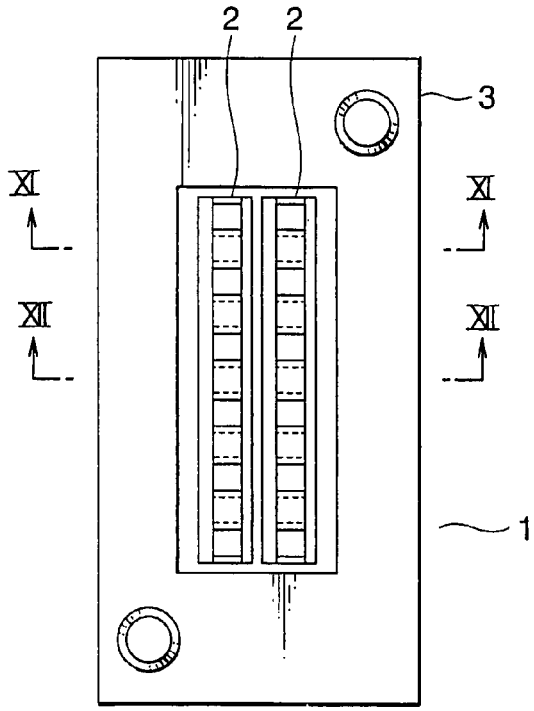
FIG. 10

DOUBLE-SIDED CONNECTOR CAPABLE OF EASILY AND ACCURATELY POSITIONING A CONNECTION MEMBER

This application claims priority to prior Japanese patent application JP 2006-98561, the disclosure of which is incorporated herein by reference.

BACKGROUND OF THE INVENTION

This invention relates to a connector adapted to be interposed between two connection objects to electrically connect the connection objects to each other.

A connector of the type is disclosed, for example, in Japanese Unexamined Patent Application Publication (JP-A) No. 2005-228504. Referring to FIGS. 1 to 5, the connector will hereinafter be described.

FIG. 1 is a perspective view showing an assembling process of the connector. The connector depicted by 21 comprises a frame 22, two connection members 23 received in two receiving holes 22*a* formed at the center of the frame 22, respectively, and a pair of single-sided adhesive tapes 24 and 25 adhered to opposite surfaces of the frame 22, respectively.

The frame 22 is produced from a synthetic resin material into a rectangular plate-like shape. At the center of the frame 22, the two receiving holes 22*a* of a rectangular shape are formed to penetrate the frame 22 and extend in parallel to each other. The frame 22 is provided with a pair of positioning bosses 22*b* formed at two diagonal corners on one surface thereof to protrude therefrom. The positioning bosses 22*b* serve to position the connector 21 with respect to a printed circuit board.

Each of the connection members 23 comprises an insulating elastic member 23*a* made of a material such as rubber or gel and a plurality of conductive films 23*b* formed on the elastic member 23*a* at equal intervals to extend over a top surface, one side surface, and a bottom surface of the elastic member 23*a*. The conductive films 23*b* are formed by appropriate means, such as sputtering. As shown in FIGS. 2A to 2D, the elastic member 23*a* has a pair of protrusions 23*a*1 formed on the other side surface (i.e., the surface without the conductive films 23*b*) in the vicinity of longitudinal opposite ends thereof.

The single-sided adhesive tapes 24 and 25 are congruent in shape with the opposite surfaces of the frame 22. The single-sided adhesive tapes 24 and 25 are provided with a plurality of rectangular holes 24*a* and 25*a* formed by punching so as to allow the conductive films 23*b* of the two connection members 23 to protrude therefrom. The single-sided adhesive tape 24 has a pair of circular holes 24*b* formed by punching at two diagonal corners thereof.

Referring to FIGS. 3 to 5, description will be made of a method of fixing the connection members 23 to the frame 22.

At first, as illustrated at a left side in FIG. 3, each connection member 23 is inserted into the receiving hole 22*a* of the frame 22 in a direction depicted by a white arrow in the figure. Then, the protrusions 23*a*1 are brought into press contact with an inner surface of the receiving hole 22*a* so that the connection member 23 is provisionally or temporarily fixed to the frame 22 as shown at a right side in FIG. 3. In order to prevent each conductive film 23*b* from being damaged during insertion, each receiving hole 22*a* is provided with a chamfered portion 22*c* formed on a surface faced to the conductive films 23*b*.

Next, as illustrated in FIG. 4, the single-sided adhesive tapes 24 and 25 are adhered to the opposite surfaces of the frame 22 as depicted by white arrows in the figure, respectively. Then, the connector 21 is assembled as shown in FIG. 5. In this state, the single-sided adhesive tapes 24 and 25 are adhered to narrow portions 23*a*2 of the elastic members 23*a*. As a consequence, the connection members 23 are permanently fixed to the frame 22.

SUMMARY OF THE INVENTION

The connector 21 disclosed in Japanese Unexamined Patent Application Publication (JP-A) No. 2005-228504 is disadvantageous in the following respects.

1. When the connection member 23 is inserted into the frame 22, it is difficult to properly fit the connection member 23 to the frame 22 because of a nonuniform press-fit depth due to warp of the frame 22 and variation in frictional force between the frame 22 and the protrusions 23*a*1 of the elastic member 23*a* of the connection member 23.

2. The connection member 23 press-fitted to the frame 23 is provisionally or temporarily fixed. In order to prevent the connection member 23 from being released from the frame 22, the single-sided adhesive tapes 24 and 25 are used. If the tapes 24 and 25 are applied with peeling force, the tapes 24 and 25 are partly peeled from the frame 22 so that the connection member 23 is displaced in a vertical direction. If the connector 21 is subjected to significant vibration or mechanical shock, the tapes 24 and 25 are peeled off from the frame 22. In this event, the connection member 23 is released from the frame 22.

3. When the conductive film 23*b* is damaged, the connection member 23 must be exchanged. In this event, the tapes 24 and 25 in an exchange area must be peeled from the frame 22. This means a decrease in working efficiency. When the tapes 24 and 25 are peeled, another conductive film 23*b* may be damaged.

4. The connector 21 comprises the connection members 23, the frame 22, and the tapes 24 and 25. Thus, the number of parts is large and assembling and disassembling operations are troublesome.

It is therefore an object of this invention to provide a connector in which a connection member can be easily and accurately positioned with respect to a frame.

It is another object of this invention to provide a connector in which a connection member is prevented from being displaced with respect to a frame and from being released from the frame.

It is still another object of this invention to provide a connector in which a connection member is easily and simply exchanged.

It is yet another object of this invention to provide a connector which has a small number of parts and is easily and simply assembled and disassembled.

Other objects of the present invention will become clear as the description proceeds.

According to an aspect of the present invention, there is provided a connector for connecting two connection objects to each other, the connector comprising a frame having an engaged portion and a connection member adapted to be inserted into the frame either in a first direction or in a second direction reverse to the first direction, the connection member comprising an elastic member coupled to the frame, a conductor coupled to the elastic member and protruding from the frame in the first and the second directions to be electrically connected to the connection objects, a first engaging portion protruding from the elastic member in a third direction perpendicular to the first direction to be engaged with the engaged portion in the first direction, and a second engaging portion protruding from the elastic member in the third direction to be engaged with the engaged portion in the second direction, the first engaging portion having a first slant surface formed on a side opposite to the engaged portion and inclined to be closer to the elastic member towards the second direction, the second engaging portion having a second slant surface formed on the side opposite to the engaged portion and inclined to be closer to the elastic member towards the first direction.

According to another aspect of the present invention, there is provided a connector for connecting two connection objects to each other, the connector comprising a connection member and a frame holding the connection member, the connection member comprising an elastic member, a conductor coupled to the elastic member and protruding from the frame to be electrically connected to the connection objects, and an engaging portion coupled to the elastic member, the frame having an engaged portion to be engaged with the engaging portion, the engaging portion being made of a material higher in rigidity than the elastic member.

BRIEF DESCRIPTION OF THE DRAWINGS

FIG. 9A is an enlarged perspective view of a connection member illustrated in FIG. 7;

FIG. 9B is a perspective view of the connection member illustrated in FIG. 7 as seen from the other side;

FIG. 10 is a plan view of the connector illustrated in FIG. 6;

DESCRIPTION OF THE PREFERRED EMBODIMENT

Figure 1:
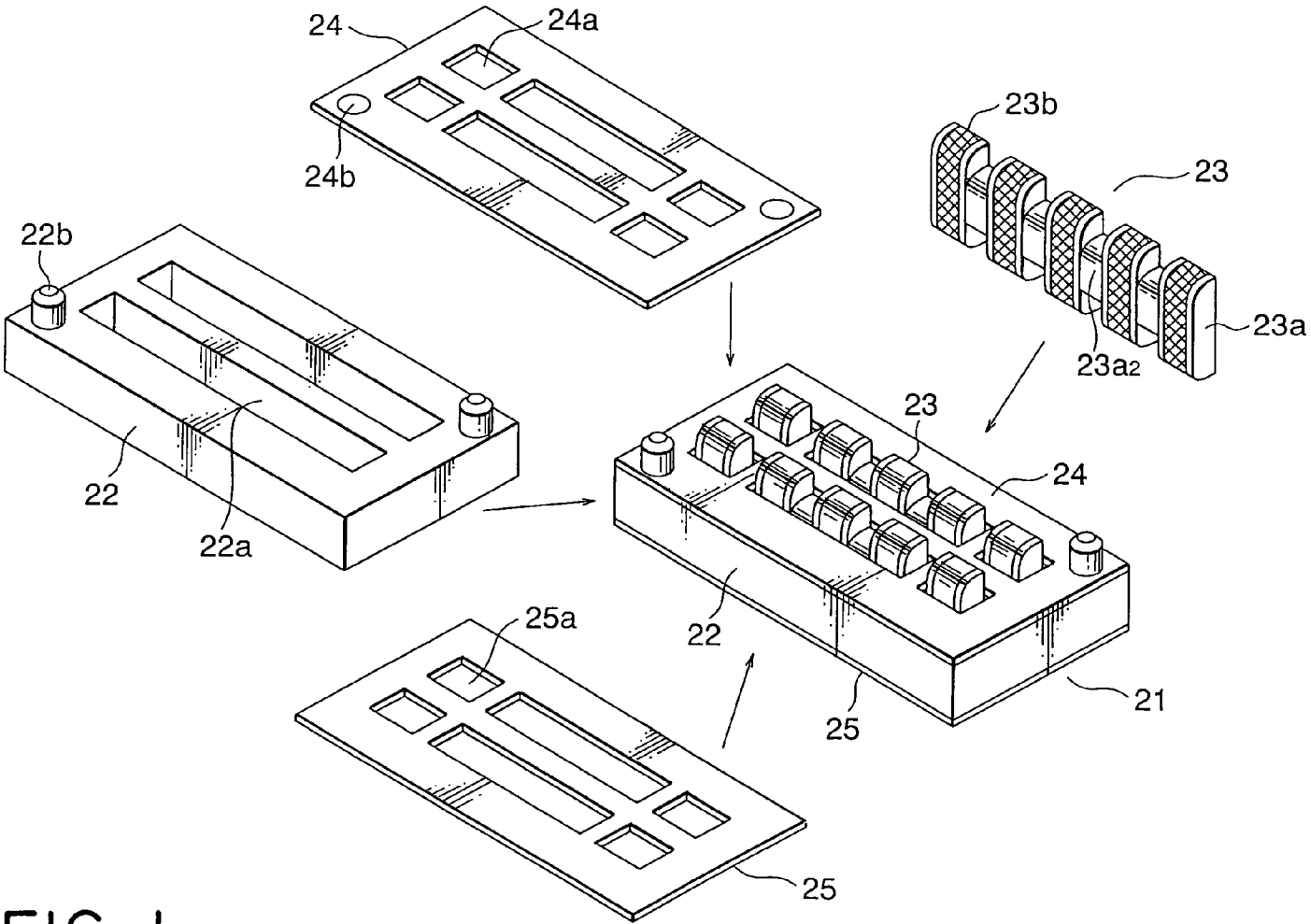
FIG. 1 is an exploded perspective view of a conventional connector.
Figure 2A:
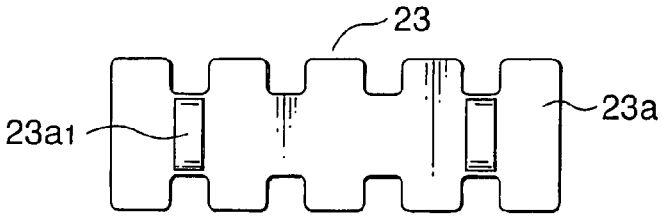
FIG. 2A is a rear view of a connection member of the connector illustrated in FIG. 1.
Figure 2B:
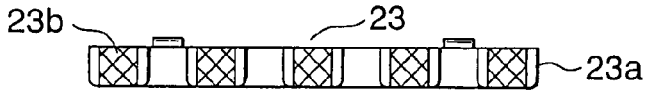
FIG. 2B is a plan view of the connection member.
Figure 2C:
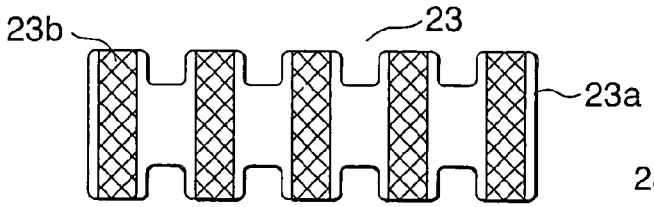
FIG. 2C is a front view of the connection member.
Figure 2D:
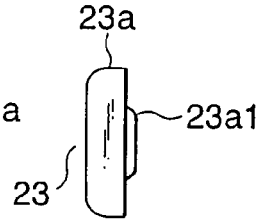
FIG. 2D is a side view of the connection member.
Figure 3:
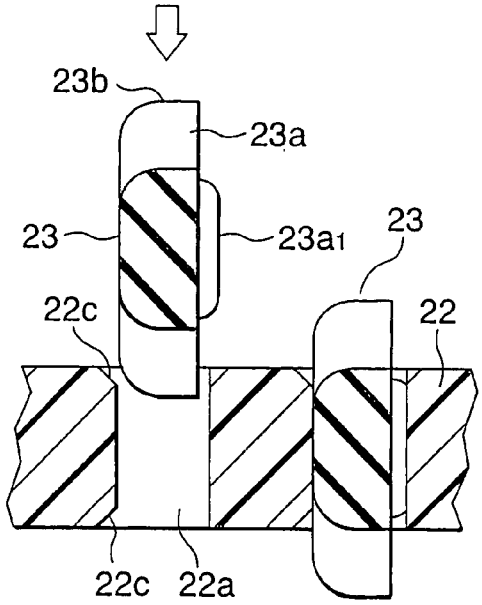
FIG. 3 is a sectional view showing the connector illustrated in FIG. 1 in a first stage of assembling.
Figure 4:
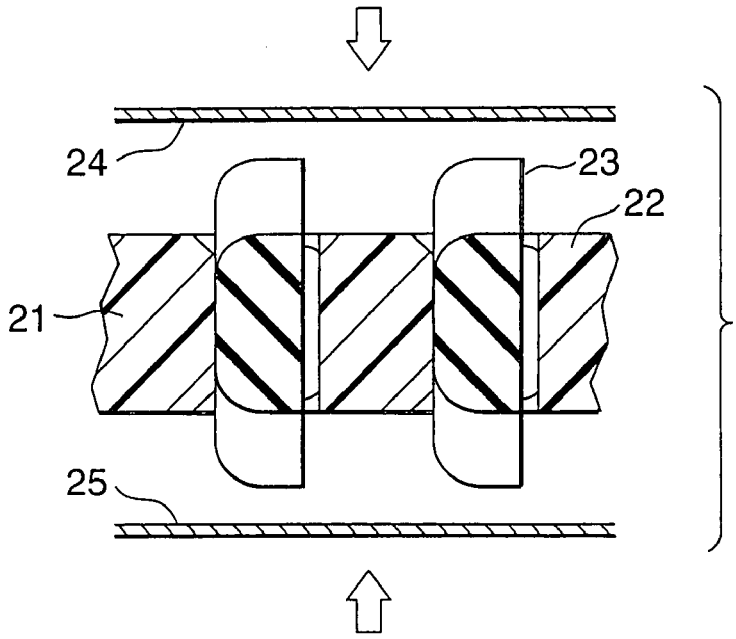
FIG. 4 is a sectional view showing the connector illustrated in FIG. 1 in a second stage of assembling.
Figure 5:
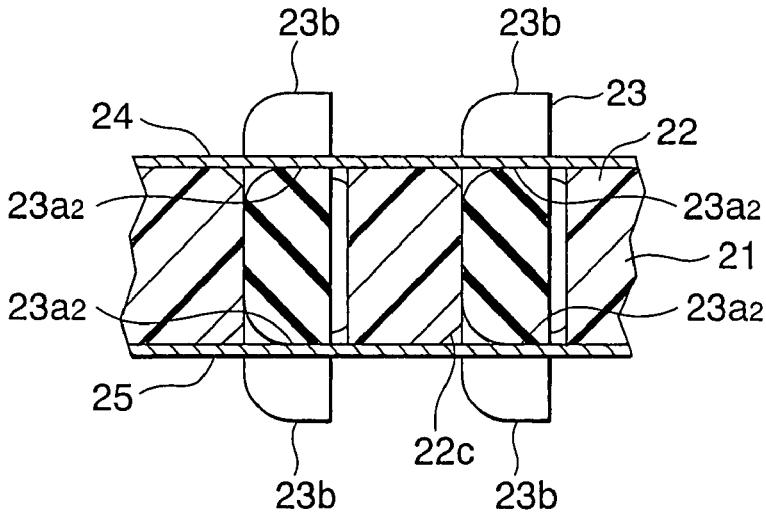
FIG. 5 is a sectional view showing the connector illustrated in FIG. 1 after completion of assembling.
Figure 6:
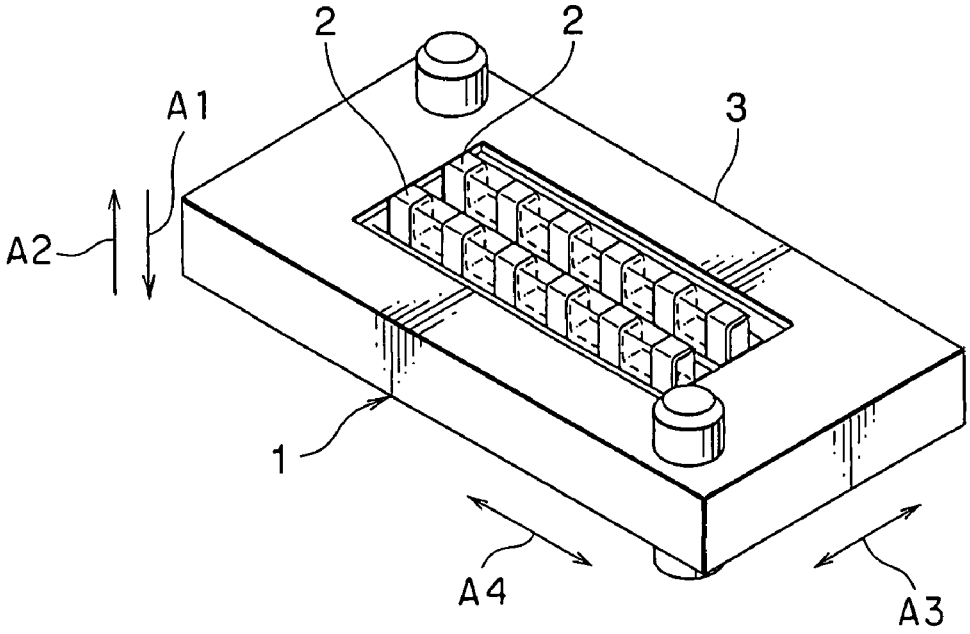
FIG. 6 is a perspective view of a connector according to a first embodiment of this invention.
Figure 7:
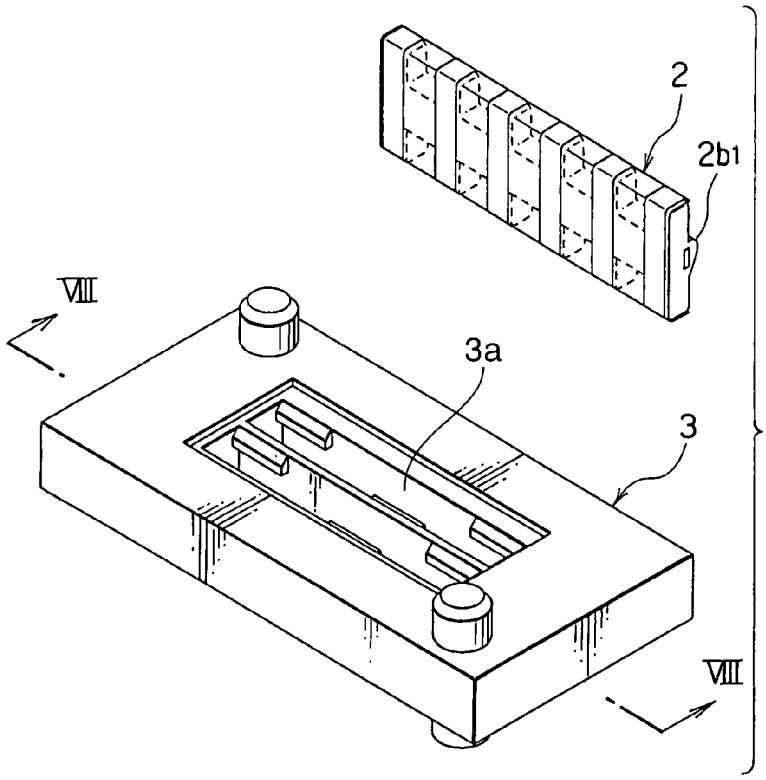
FIG. 7 is an exploded perspective view of the connector illustrated in FIG. 6.
Figure 8:
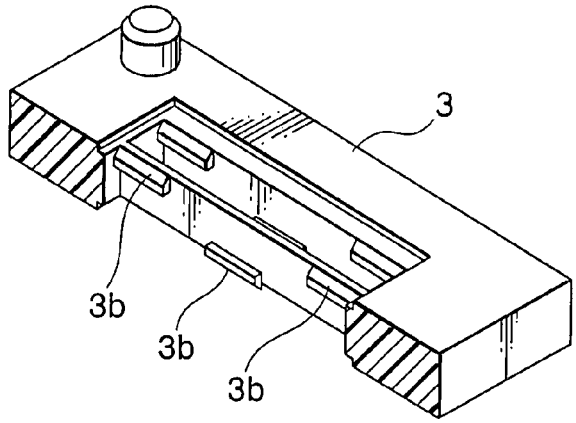
FIG. 8 is a sectional perspective view of a frame illustrated in FIG. 7, taken along a line VIII-VIII.

Referring to FIGS. 6 to 10, description will be made of a structure of a connector according to a first embodiment of this invention.

The connector illustrated in the figure is a double-sided connector, i.e., a connector for double side connection. Specifically, the double-sided connector 1 illustrated in FIG. 6 comprises a plurality of, namely, two connection members 2 (FIGS. 9A and 9B) fitted to a frame 3 in parallel to each other. Each of the connection members 3 comprises a bone 2*a* as a strengthening member and an elastic member 2*b* formed around the bone 2*a*. On an outer surface of the elastic member 2*b*, an insulating sheet 2*c* is wound around. The insulating sheet 2*c* is fixed to the elastic member 2*b*, for example, by the use of an adhesive. The insulating sheet 2*c* is provided with a plurality of conductors 2*d* arranged at a predetermined pitch. Each of the conductors 2*d* is fixed to the insulating sheet 2*c*, for example, by the use of an adhesive. Thus, the connection member 2 is formed.

The bone 2*a* is made of a metal material having rigidity, such as stainless steel. Alternatively, the bone 2*a* may be made of an insulating resin, such as plastic, or a plastic material same as that of the frame 3. The elastic member 2*b* is made of an insulating material having flexibility. Each conductor 2*d* comprises a multilayer film such as a gold-plated copper foil.

The frame 3 is provided with a plurality of slits 3*a* to receive the connection members 2 to be inserted therethrough at equal intervals. Herein, two slits 3*a* are formed to receive the two connection members 2. Each slit 3*a* is provided with three frame protrusions (an engaged portion) 3*b* including two upper side frame protrusions and one lower side frame protrusion alternately formed up and down. A combination of the upper and the lower side frame protrusions 3*b* may also be called an engaged portion.

Each of the connection members 2 can be fitted into each slit 3*a* of the frame 3 either in a first direction A1 or in a second direction A2 reverse to the first direction A1. The connection member 2 has a plurality of engaging portions (hereinafter called "dowel portions") 2*b*1 protruding from the elastic member 2*b* in a third direction A3 perpendicular to the first direction A1. The dowel portions 2*b*1 are made of a material same as that of the elastic member 2*b* and integrally formed with the elastic member 2*b*. The bone 2*a* is embedded in the elastic member 2*b* at a position corresponding to each dowel portion 2*b*1.

The dowel portions 2*b*1 have three stopper surfaces 2*b*2 corresponding to the three frame protrusions 3*b*. Each dowel portion 2*b*1 has a slant surface 2*b*3 formed on the side opposite to the stopper surface 2*b*2. Thus, the dowel portion 2*b*1 is defined between the stopper surface 2*b*2 and the slant surface 2*b*3. In a fourth direction A4 perpendicular to the first and the third directions A1 and A3, the stopper surfaces 2*b*2 and the slant surfaces 2*b*3 are alternately reversed in position in correspondence to the frame protrusions 3*b*. Specifically, the dowel portions 2*b*1 are arranged adjacent to one another in the fourth direction A4. The slant surface 2*b*3 of one of the dowel portions 2*b*1 adjacent to each other (i.e., the first engaging portion) is inclined to be closer to the elastic member 2*b* towards the second direction A2 while the slant surface 2*b*3 of the other (i.e., the second engaging portion) is inclined to be closer to the elastic member 2*b* towards the first direction A1.

The conductors 2*d* protrude from the frame 3 in the first and the second directions A1 and A2. As will later become clear, two connection objects are brought into press contact with protruding portions of the conductors 2*d* protruding from the frame 3, respectively. As a consequence, the connection objects are electrically connected to each other via the conductors 2*d*.

Figure 11:
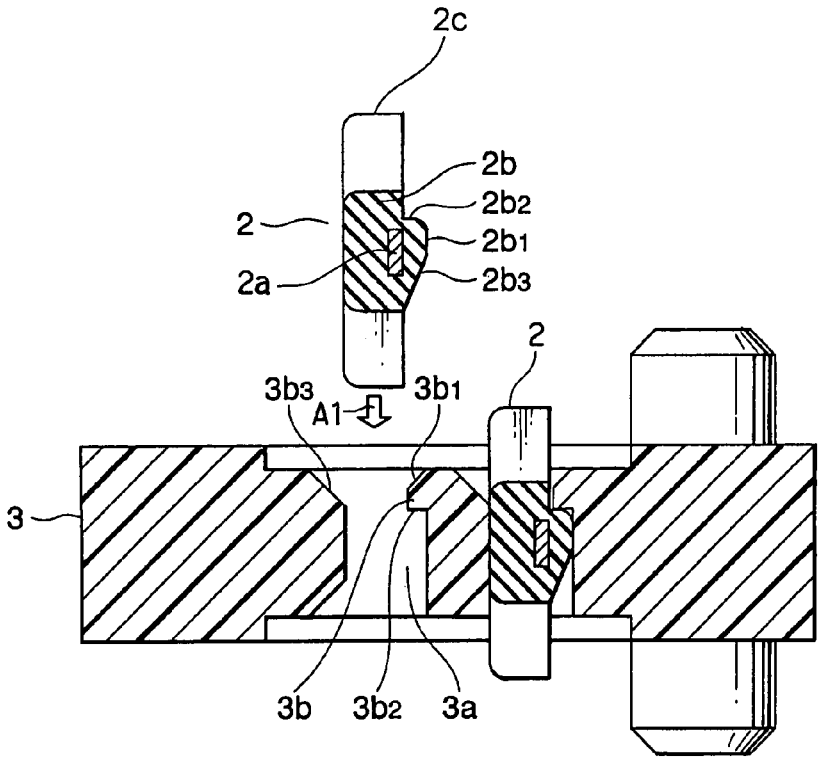
FIG. 11 is a sectional view taken along a line XI-XI in FIG. 10, showing a state where one of connection members is not yet fitted to the frame.
Figure 12:
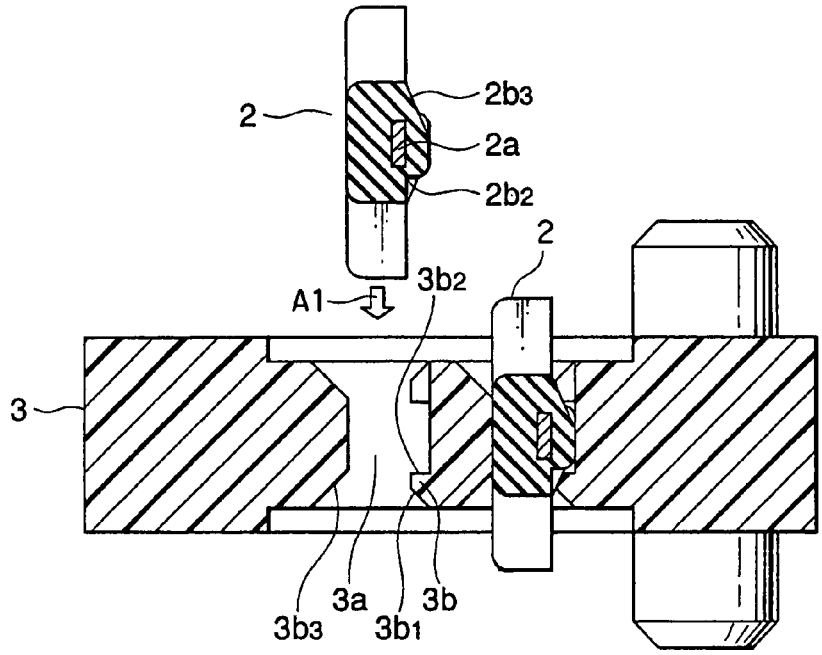
FIG. 12 is a sectional view similar to FIG. 11 but taken along a line XII-XII in FIG. 10.

Referring to FIGS. 11 and 12, description will be made of a method of inserting (fitting) the connection member 2 into the frame 3.

Referring to FIG. 11, consideration will be made of an area where the frame protrusion 3*b* is present on an upper side of the slit 3*a*. When the connection member 2 is inserted into the frame 3 in the first direction A1, the connection member 2 is at first guided by a slant surface 3*b*1 formed on the frame protrusion 3*b* and, if necessary, guided by a tapered portion 3*b*3 to be inserted into the slit 3*a*. Next, the slant surface 2*b*3 of the connection member 2 is brought into contact with the frame protrusion 3*b*. Subsequently, the slant surface 2*b*3 of the connection member 2 is brought into contact with the slant surface 3*b*1 of the frame 3. Consequently, the elastic member 2*b* is deformed to move across the slant surfaces 3*b*1.

Referring to FIG. 12, consideration will be made of another area where the frame protrusion 3*b* is present on a lower side of the slit 3*a*. When the connection member 2 is inserted into the frame 3 in the first direction A1, the connection member 2 does not interfere with the frame 3. Finally, the stopper surface 2*b*2 of the connection member 2 is brought into contact with a stopper surface 3*b*2 formed on the frame protrusion 3*b*. Then, insertion of the connection member 2 is finished.

The slant surface 2*b*3 of the dowel portion 2*b*1 in the illustrated example has a tapered shape. Alternatively, the slant surface 2*b*3 may have a corner-chamfered shape, a corner-rounded shape, or a rounded shape. The slant surface 2*b*3 may have any appropriate shape without being limited to the embodiment.

Finally, the connection member 2 is fixed in the state where the stopper surfaces 2*b*2 are clamped by the frame protrusions 3*b* protruding from the slit 3*a* of the frame 3 alternately up and down. Therefore, the connection member 2 is easily and accurately positioned with respect to the frame 3.

In FIGS. 11 and 12, the frame 3 has a symmetrical shape in a vertical direction. As will readily be understood, the connection member 2 can also be inserted from a lower side of the frame 3 in the second direction A2.

In the foregoing description, each of the number of the dowel portions 2*b*1 and the number of the frame protrusions 3*b* is three. However, the number may be two or four or more.

With the above-mentioned connector, the following merits are expected.

1. It is possible to reduce a cost because the connection member 2 can be fixed to the frame 3 without requiring adhesive tapes.

2. It is possible to easily and accurately position the connection member with respect to the frame by engagement between the engaging portions formed on the elastic member of the connection member and the engaged portions of the frame.

3. It is possible to reliably prevent the connection member from being displaced with respect to the frame and from being released from the frame because the engaging portions of the connection member are engaged with the engaged portions of the frame.

4. It is possible to easily and simply exchange the connection member by disengaging the engaging portions of the elastic member of the connection member from the engaged portions of the frame.

5. The connector can be assembled and disassembled conveniently because the connection member can be inserted into the frame either from one side or from the other side of the frame.

6. The connector has a small number of parts and is easily and simply assembled and disassembled because the connector comprises the connection members and the frame.

Next referring to FIG. 13, description will be made of a connector according to a second embodiment of this invention. Similar parts are designated by like reference numerals and description thereof will be omitted.

Figure 13:
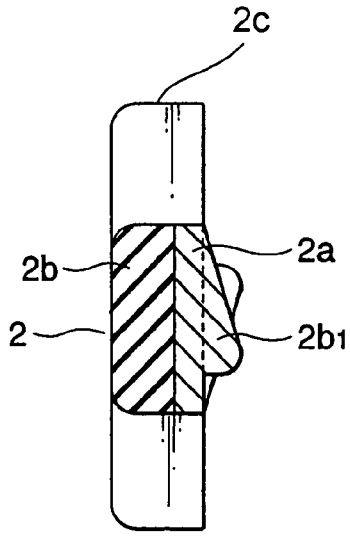
FIG. 13 is a sectional view of a connection member of a connector according to a second embodiment of this invention.

In a connection member 2 illustrated in FIG. 13, a bone 2*a* is formed at positions corresponding to dowel portions 2*b*1. The dowel portions 2*b*1 are made of a material same as that of the bone 2*a* and integrally formed with the bone 2*a*. Thus, the structure of the connection member 2 may be modified in various manners.

With the above-mentioned connector also, similar merits to those of the connector described in connection with FIGS. 6 to 12 are expected.

Figure 14:
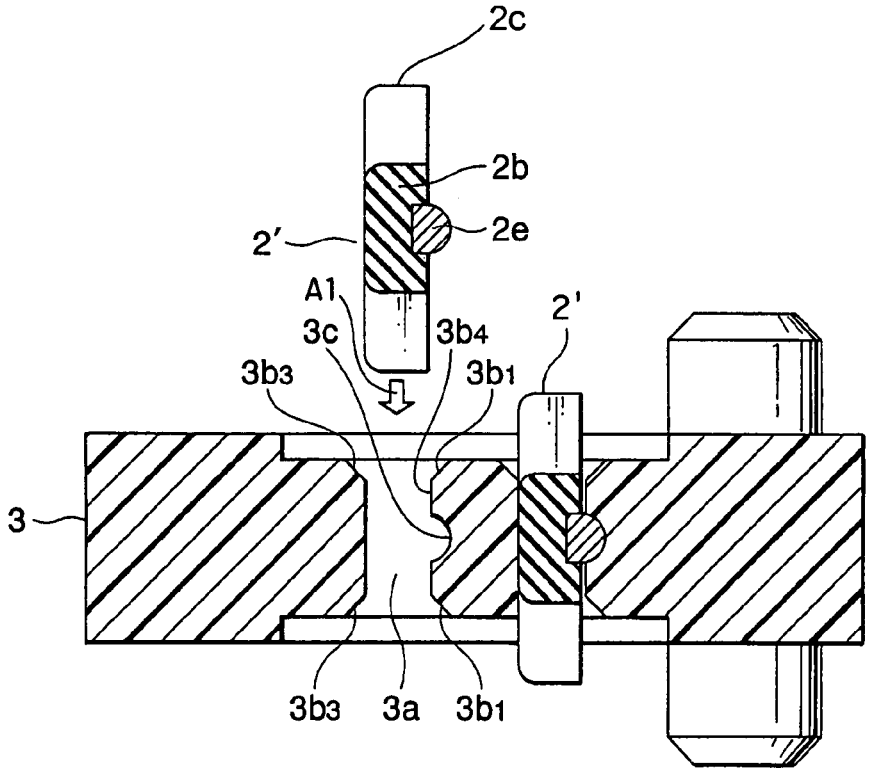
FIG. 14 is a sectional view of a connector according to a third embodiment of this invention, showing a state where one of connection members is not yet fitted to a frame.

Referring to FIG. 14, description will be made of a connector according to a third embodiment of this invention. Similar parts are designated by like reference numerals and description thereof will be omitted.

In FIG. 14, a connection member 2' comprises an elastic member 2*b*, an insulating sheet 2*c*, a plurality of conductors 2*d*, and a protruding portion 2*e*. A frame 3 has a pair of slits 3*a* each of which has a frame recess 3*c* formed at the center to serve as an engaged portion.

When the connection member 2' is inserted into the slit 3*a* of the frame 3 in a first direction A1, the protruding portion 2*e* of the connection member 2' is brought into contact with a slant surface 3*b*1. Thereafter, the protruding portion 2*e* is brought into contact with a flat portion 3*b*4 to be pushed leftward so that the elastic member 2*b* is deformed. When the connection member 2' is further inserted, the protruding portion 2*e* is engaged with the frame recess 3*c* so that the elastic member 2*b* is recovered into an original shape and fixed.

The protruding portion 2*e* is made of a metal high in rigidity than the elastic member 2*b* but may be made of high-rigidity plastic or the like.

With the above-mentioned connector also, similar merits to those of the connector described in connection with FIGS. 6 to 12 are expected.

Figure 15:
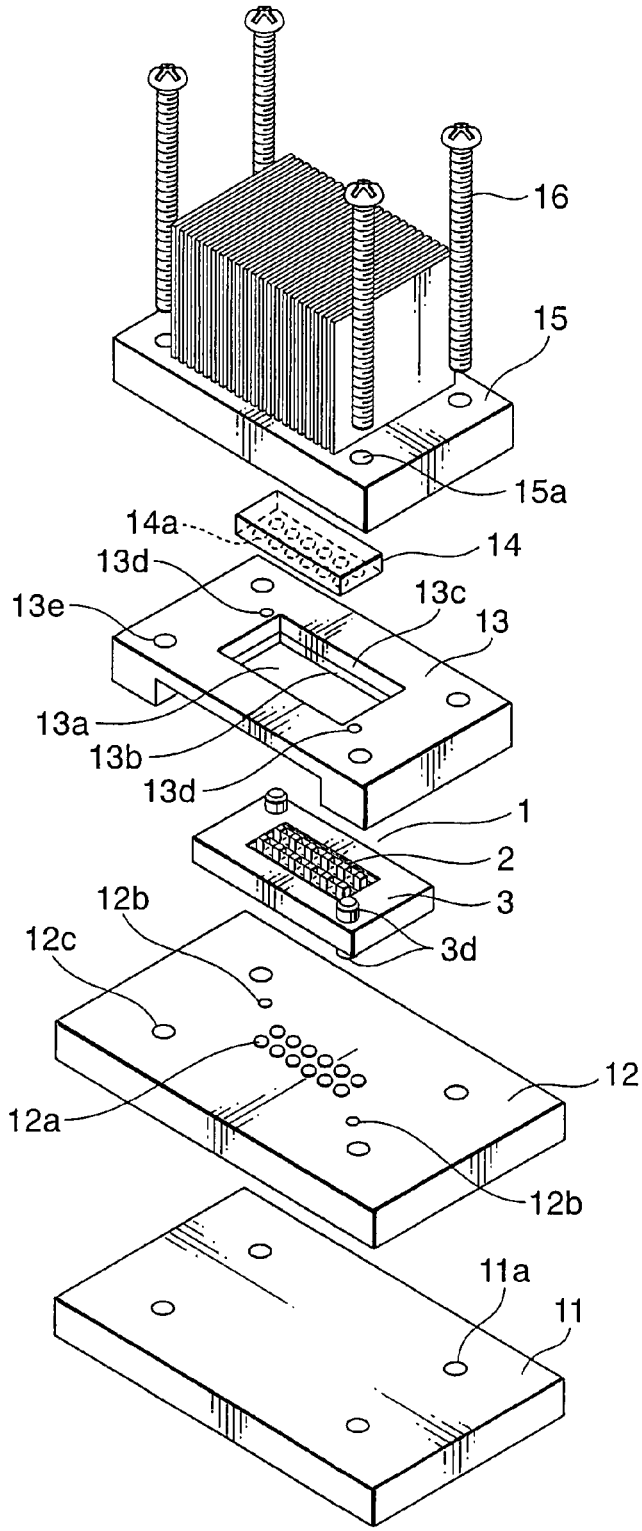
FIG. 15 is an exploded perspective view for describing an apparatus in which the connector according to this invention is used.
Figure 16:
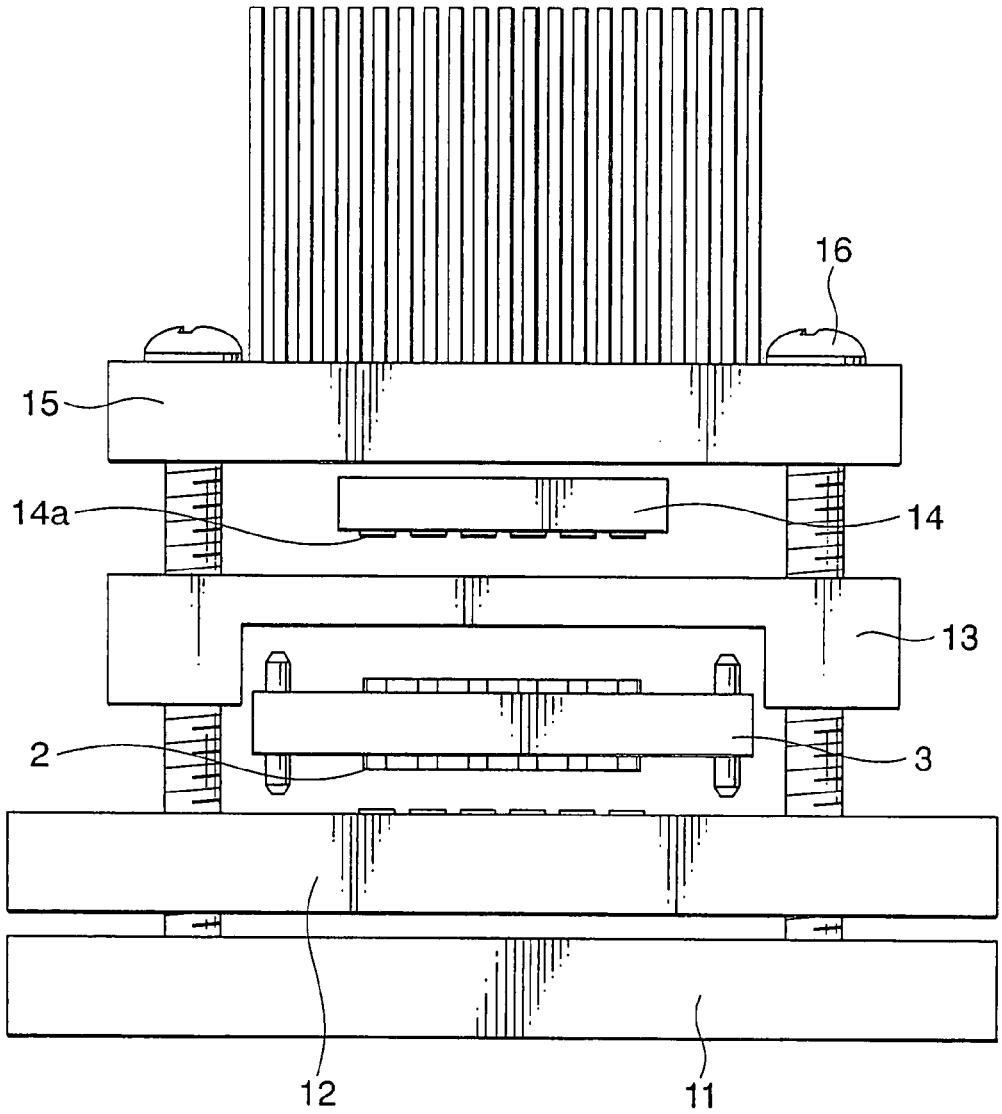
FIG. 16 is a front view of the apparatus in FIG. 15 in the middle of assembling.
Figure 17:
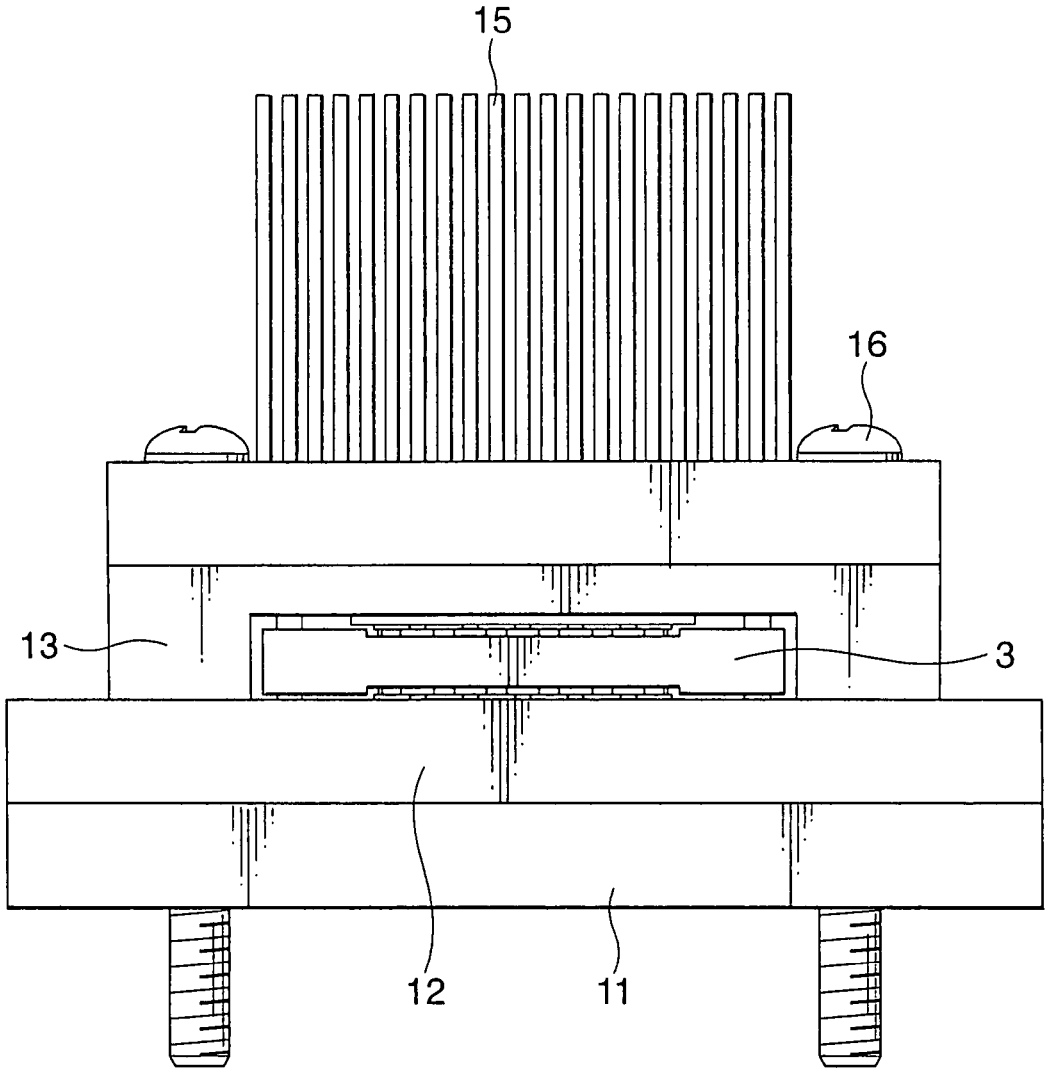
FIG. 17 is a sectional view of the apparatus in FIG. 15 after completion of assembling.

Referring to FIGS. 15 to 17, description will be made of an example where the above-mentioned connector is used to connect a printed circuit board and a module to each other. Herein, the connector may be any one of the connectors according to the first through the third embodiments.

In FIG. 15, various parts will be described in the order from a lowest one. A strengthening plate 11 made of a high-rigidity material such as stainless steel is provided with four threaded holes 11*a*. A printed wiring board 12 is provided with a plurality of lands 12*a* made of gold, nickel, copper, or the like, two positioning holes 12*b*, and four through holes 12*c*. The frame 3 of the double-sided connector 1 has opposite surfaces each of which is provided with two positioning pins 3*d*. A plastic or metal frame 13 is provided with a module insertion opening 13*a* formed at its center, an opening side wall 13*b*, an opening tapered portion 13*c*, two positioning holes 13*d*, and four through holes 13*e*. A module 14 is a land grid array having a plurality of lands 14*a*. A heat sink 15 is made of a material excellent in heat conductivity, such as copper or aluminum, and is provided with four through holes 15*a*.

As illustrated in FIG. 16, four screws 16 are inserted into the four through holes 15*a* of the heat sink 15, the four through holes 13*e* of the frame 13, the four through holes 12*c* of the printed circuit board 12, and the four threaded holes 11*a* of the strengthening plate 11, respectively.

Subsequently, the module 14 is inserted into the module insertion opening 13*a* of the frame 13. The two positioning pins 3*d* on one surface of the double-sided connector 1 and the two positioning pins 3*d* on the other surface are inserted into the two positioning holes 13*d* of the frame 13 and the two positioning holes 12*b* of the printed wiring board 12, respectively.

Finally, the four screws 16 are tightened. Then, assembling is completed as illustrated in FIG. 17 (fitted state).

While the present invention has thus far been described in connection with the preferred embodiments thereof, it will readily be possible for those skilled in the art to put this invention into practice in various other manners.

What is claimed is:

1. A connector for connecting two connection objects to each other, the connector comprising:

a frame having an engaged portion; and a connection member adapted to be inserted into the frame either in a first direction or in a second direction reverse to the first direction;

the connection member comprising:

an elastic member coupled to the frame;

a conductor coupled to the elastic member and protruding from the frame in the first and the second directions to be electrically connected to the connection objects;

a first engaging portion protruding from the elastic member in a third direction perpendicular to the first direction to be engaged with the engaged portion in the first direction; and a second engaging portion protruding from the elastic member in the third direction to be engaged with the engaged portion in the second direction;

the first engaging portion having a first slant surface formed on a side opposite to the engaged portion and inclined to be closer to the elastic member towards the second direction;

the second engaging portion having a second slant surface formed on the side opposite to the engaged portion and inclined to be closer to the elastic member towards the first direction.

2. The connector according to claim 1, wherein each of the first and the second engaging portions has a stopper surface extending in the third direction and faced to the engaged portion.

3. The connector according to claim 1, wherein:

the connection member has as strengthening member higher in rigidity than the elastic member and formed at positions corresponding to the first and the second engaging portions;

the first and the second engaging portions being made of a material same as that of the strengthening member and integrally formed with the strengthening member.

4. The connector according to claim 1, wherein:

the frame has a slit penetrating the frame in the first direction and receiving the connection member;

the engaged portion having a slant surface formed at a position adjacent to the slit to be engaged with the first and the second slant surfaces when the connection member is inserted into the slit.

5. The connector according to claim 1, wherein the first and the second engaging portions are arranged adjacent to each other in a direction perpendicular to the first and the third directions;

the engaged portion having:

a first engaged portion to be engaged with the first engaging portion; and a second engaged portion to be engaged with the second engaging portion;

the first and the second engaged portions being displaced from each other in the first direction.

6. The connector according to claim 1, wherein the first and the second engaging portions are made of a material same as that of the elastic member and integrally formed with the elastic member.

7. The connector according to claim 6, wherein the connection member has a strengthening member higher in rigidity than the elastic member and formed at positions corresponding to the first and the second engaging portions.

8. The connector according to claim 7, wherein the strengthening member is embedded in the elastic member.

* * * * *